US005326408A

United States Patent [19]

Cormier

[11] Patent Number: 5,326,408

[45] Date of Patent: Jul. 5, 1994

[54] RAPIDLY DISSOLVING AND STORAGE STABLE TITANIUM PHOSPHATE CONTAINING ACTIVATING COMPOSITION

[75] Inventor: Gerald J. Cormier, Troy, Mich.

[73] Assignee: Henkel Corporation, Plymouth Meeting, Pa.

[21] Appl. No.: 77,473

[22] Filed: Jun. 15, 1993

[51] Int. Cl.[5] ..... C23C 22/05; C23C 22/78

[52] U.S. Cl. ..... 148/254; 148/253; 148/256; 106/14.12

[58] Field of Search ..... 106/14.12; 148/26, 28, 148/254, 256, 253

[56] References Cited

U.S. PATENT DOCUMENTS

| | | | |
|---|---|---|---|
| 2,310,239 | 2/1943 | Jernstedt | 148/254 |
| 2,462,196 | 2/1949 | Jernstedt | 148/254 |
| 2,490,062 | 12/1949 | Jernstedt | 148/254 |
| 2,864,732 | 12/1958 | Miller et al. | 148/254 |
| 3,741,747 | 6/1973 | Hamilton | 148/254 |
| 3,864,139 | 2/1975 | Heller | 106/14.12 |
| 4,152,176 | 5/1979 | Guhde | 148/254 |
| 4,497,667 | 2/1985 | Vashi | 148/254 |
| 4,539,051 | 9/1985 | Hacias | 148/254 |
| 4,957,568 | 9/1990 | Endros et al. | 148/254 |
| 5,026,423 | 6/1991 | Ngo | 106/14.12 |
| 5,112,395 | 5/1992 | Ngo | 106/14.12 |
| 5,112,414 | 5/1992 | Brands et al. | 148/254 |

*Primary Examiner*—Anthony Green

*Attorney, Agent, or Firm*—Ernest G. Szoke; Wayne C. Jaeschke; Norvell E. Wisdom, Jr.

[57] ABSTRACT

An otherwise conventional Jernstedt salt dispersion for activating metal surfaces to improve the quality of subsequently deposited phosphate conversion coatings on the activated metal surface is stabilized against deterioration in storage for at least six months by utilizing in the dispersion a mixture of sodium and potassium salts, preferably condensed phosphate salts, in such amounts that the ratio of potassium to titanium is within the range from 8.0:1.0 to 40:1.0 and the ratio of potassium to sodium is within the range from 0.9:1.0 to about 2.5:1.0.

20 Claims, No Drawings

RAPIDLY DISSOLVING AND STORAGE STABLE TITANIUM PHOSPHATE CONTAINING ACTIVATING COMPOSITION

FIELD OF THE INVENTION

This invention relates to the well known process of "activating" a metal surface before applying a phosphate conversion coating thereto and to compositions useful in the activating process. By contacting the metal surface with an aqueous liquid composition containing a colloidal dispersion of titanium phosphate, the quality of subsequently deposited phosphate conversion coatings on the thus activated surface is substantially improved, i.e., the conversion coating produced is finer grained, smoother, and promotes better adhesion of subsequently applied paint or similar protective organic binder containing coating materials.

BACKGROUND OF THE INVENTION AND RELATED ART

The manufacture and use of titanium conditioning compositions was first taught by Jernstedt in 1943, and the titanium containing phosphates useful for the purpose are often still referred to in the art as "Jernstedt salts." In current commercial practice, the activating chemicals that produce the best activating effect are generally supplied to the user as powders, which are to be dispersed in water by the user a fairly short time before use. The dispersion process is notoriously slow in practice, leading to frequent difficulties in reproducibility and/or efficiency of operations.

Various attempts have been made to overcome the difficulties associated with the slow dispersion rate of conventional activating powders by supplying the critical form of titanium phosphate in predispersed form. However, all previously known liquid concentrate forms of activating composition suffer from one or more difficulties, among which a predominant one is instability in storage. One major object of this invention is to provide a liquid concentrate with good stability in storage. Another object to provide a powdered solid concentrate with a rapid dispersion/dissolution rate in water. Other objects will be apparent from the description below.

DESCRIPTION OF THE INVENTION

Other than in the operating examples and claims, or where otherwise expressly indicated, all numbers expressing conditions of use or quantities of ingredients used herein are to be understood as modified in all instances by the term "about" in describing the broadest aspects of the invention. Practice within the numerical limits given is generally preferred, however. Also, unless expressly stated to the contrary: percent and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; and any counterions thus implicitly specified should preferably be selected from among other constituents explicitly specified in ionic form, to the extent possible; otherwise such counterions may be freely selected, except for avoiding counterions that act adversely to the stated objects of the invention.

SUMMARY OF THE INVENTION

It has been found that a combination of conventional titanium phosphate Jernstedt salts with a combination of sodium and potassium salts in properly selected amounts produces a mixture that dissolves and disperses about three times more rapidly than previously known powder form activating concentrates and that the same combination of materials in aqueous solution/dispersion constitutes a readily dilutable liquid concentrate that, in optimal embodiments, is stable in storage for at least six months.

Accordingly, one major embodiment of the present invention is a powdered solid mixture comprising, preferably consisting essentially of, or most preferably consisting of:

(A) a component of Jernstedt titanium phosphate salt or salts;

(B) a component of water soluble sodium salt or salts; and (C) a component of water soluble potassium salt or salts; and, optionally, one or more of the following:

(D) a component of thickening agent; and (E) conventional alkaline cleaner (for metals) component(s) other than those recited above, preferably selected from the group consisting of surfactant(s) and sodium and/or potassium carbonate(s), silicate(s) and/or hydroxide(s), wherein in the total mixture the ratio of potassium to the titanium in the Jernstedt salts is within the range from 8.0:1.0 to 24:1.0 and the ratio of potassium to sodium is within the range from 1.0:1.0 to 2.5:1.0. For the purposes of this description, a salt is considered to be water soluble if it is soluble to the extent of at least 10 grams per liter (hereinafter often abbreviated "g/L") in water at 25° C.

Another major embodiment of the invention is a liquid activating concentrate comprising, preferably consisting essentially of, or most preferably consisting of, water and:

(A) a component of Jernstedt titanium phosphate salt or salts dispersed in the liquid concentrate;

(B) a component of sodium salt or salts dissolved in the concentrate; and (C) a component of potassium salt or salts dissolved in the concentrate; and, optionally, one or more of the following:

(D) a component of thickening agent; and (E) conventional alkaline cleaner (for metals) component(s) other than those recited above, preferably selected from the group consisting of surfactant(s) and sodium and/or potassium carbonate(s), silicate(s) and/or hydroxide(s), dissolved or dispersed in the concentrate, wherein in the total concentrate the ratio of the total content of potassium to the total content of titanium in the Jernstedt salts in the composition is within the range from 8.0:1.0 to 40:1.0 and more preferably does not exceed 24:1.0, and the ratio of potassium to sodium is within the range from 0.9:1.0 to 2.5:1.0 and more preferably is at least 1.0:1.0.

Preparation of the Jernstedt salts to be used in this invention in either dry powder form or in concentrated aqueous dispersion is well known in the art. Nonlimiting examples of such preparations are given in U.S. Pat. No. 4,539,051 of Sep. 3, 1985 to Hacias, the entire disclosure of which, to the extent not inconsistent with any explicit statement herein, is hereby incorporated herein by reference, and in other patents cited therein. A preferred method of preparation is described as part of the working examples.

Other embodiments of this invention include processes of activating surfaces with an aqueous solution/-dispersion of a concentrate as described above, and extended processes combining such activating with subsequent phosphate conversion coating and, optionally, other process steps conventional per se, such as cleaning before activation, rinsing, and final overcoating with an organic binder containing protective coating such as paint.

DESCRIPTION OF PREFERRED EMBODIMENTS

Preferably both the sodium salts of component (B) and the potassium salts of component (C) are selected from the group consisting of the phosphates, pyrophosphates, and tripolyphosphate salts, with the latter two, jointly denoted herein as "lower condensed phosphate" salts, generally more preferred than the simple phosphates. (Higher condensed phosphates, such as hexametaphosphate and the like, are equally as satisfactory as these lower condensed phosphated initially, but the higher condensed phosphates are subject to slow hydrolysis with time in aqueous solution and therefore are slightly less satisfactory technically. These higher condensed phosphates at present are also more expensive than the lower condensed phosphates.) Partially acid salts as well as the fully neutralized salts can be used satisfactorily, but fully neutralized salts are most preferred and those containing only one hydrogen atom per anion next most preferred. The single most preferred salt for component (B) is sodium tripolyphosphate (often abbreviated hereinafter as "STPP") and for component (C) is tetrapotassium pyrophosphate (often abbreviated hereinafter as "TKPP"), although in very hard water the use of some potassium tripolyphosphate (often abbreviated hereinafter as "KTPP") in addition to the tetrapotassium pyrophosphate may be more preferred than either of these salts alone.

When condensed phosphates are used, the ratio of the condensed phosphate anions to the titanium content of the Jernstedtsalts in the compositions is preferably in the range from 10:1.0 to 40:1.0, and more preferably does not exceed 30:1.0.

Although not required, the use of thickener is generally advantageous in liquid compositions in order to retard the onset of instability, from settling of the colloidally dispersed titanium phosphate Jernstedt salt. Xanthan gum thickeners have been found to be satisfactory, and, with increasing preference in the order given, are preferably used in amounts within the range from 0.02 to 1%, 0.1 to 0.8%, 0.1 to 0.5%, or 0.24 to 0.36%.

If hard water, particularly water with more than 600 grains of hardness, is used to dilute and/or prepare the concentrates according to the invention, it is advantageous to utilize sodium or potassium tripolyphosphate or both in order to increase the stability of the compositions in hard water. In liquid concentrate compositions, a total of from 1-3% of these tripolyphosphate salts is preferred. In contrast, several known chelating agents often used to improve stability of compositions in hard water had adverse effects on the concentrates according to this invention and are best avoided. These include phosphonic acids and their salts, citrates, gluconatcs, glucoheptonates, ethylene diamine tetraacetic acid and its salts, and polycarboxylates such as conventional poly{acrylic acid} latex thickeners and poly{acrylic acid} detergents. For each of these components, it is preferred, independent for each component and with increasing preference in the order given, that the compositions contain no more than 1.0, 0.5, 0.25, 0.10, 0.03, 0.009, 0.003, 0.0005, or 0.0001, % of the component.

In liquid concentrates according to the invention, it is preferred, with increasing preference in the order given, that the concentration of titanium from the Jernstedt salts lie within the range from 0.02 to 5%, from 0.05 to 2.0%, from 0.07 to 1.0%, from 0.10 to 0.70, from 0.15 to 0.50, or from 0.20 to 0.37. In working solutions, with increasing preference in the order given, the concentration of titanium from the Jernstedt salts preferably lies within the range from 0.0001 to 0.2%, from 0.0003 to 0.004%, from 0.00060 to 0.0025%, from 0.00084 to 0.0014%, or from 0.00099 to 0.00132%.

With the working concentrates according to this invention, as with other activating compositions known in the art, combination of activating with cleaning is generally not preferred for highest quality results. Instead, a separate cleaning stage followed directly (except possibly for rinsing) by the activating treatment, which in turn is directly followed (except possibly for rinsing) by application of a phosphate conversion coating is preferred for extended processes according to the invention.

The practice of the invention can be further appreciated from the following nonlimiting examples and comparison examples. In these examples, conventional solid titanium phosphate Jernstedt salts which included some sodium tripolyphosphate were prepared at three different concentration levels of titanium. The general procedure and amounts of materials used for making the salt containing 2.8% titanium was as follows (with parts being by weight):

A solids-liquids mixer in the general shape of a hollow cylinder, provided with wall plow blades and chopper blades, a hopper for storing powdered solid reagents until they are to be added to the reactor space, an input pump for liquid additions, means for removing expelled steam, and a blast protector is the reactor for the process. To this reactor 132 parts of water and 47 parts of anatase (titanium dioxide) are added and mixed together, followed by 101 parts of STPP. After these are thoroughly mixed, 326 parts of sodium hydroxide beads are added from the hopper while the chopper blades inside the mixer are running. After this has been thoroughly mixed, a total of 282 parts of 75% aqueous orthophosphoric acid slowly until the entire amount has been added and the generation of steam from the heat of reaction between the sodium hydroxide and phosphoric acid has abated. Then mixing of the contents is continued for about 15-20 minutes. Finally 125 parts of light soda ash is added and allowed to mix with the other ingredients for 15 minutes. About 361 parts of water are expelled during the reaction by the heat generated.

For Jernstedt salts with other concentrations of titanium, the amount of anatase is varied appropriately in the procedure above while keeping the other materials in the same proportion to each other.

could be useful in some applications, but they are considerably less preferred that the others in this table.

TABLE 1

| | Percent of Material in Concentrate Composition Number: | | | | | | | |
|---|---|---|---|---|---|---|---|---|
| | 1 | 2 | 3 | 4 | 5 | 6 | 7 | 8 |
| Material in Composition | | | | | | | | |
| JS-1.3 | 10 | 10 | 10 | | | | | |
| JS-2.8 | | | | 10 | 10 | 10 | | |
| JS-3.9 | | | | | | | 7 | 7 |
| TKPP | 10 | 13 | 7 | 10 | 13 | 7 | 10 | 13 |
| STPP | 1 | 1 | 1 | 1 | 1 | 1 | 1 | 1 |
| DSP | | | | | | | 2 | 2 |
| Thickener | 0.3 | 0.3 | 0.3 | 0.3 | 0.3 | 0.3 | 0.3 | 0.3 |
| Water | Balance to 100% for all compositions | | | | | | | |
| K:Ti Rat. | 35:1 | 47:1 | 25:1 | 17:1 | 22:1 | 12:1 | 17:1 | 23:1 |
| Cond. P:Ti | 46:1 | 58:1 | 34:1 | 21:1 | 27:1 | 16:1 | 22:1 | 28:1 |
| K:Na Rat. | 1.4:1.0 | 1.9:1.0 | 1.0:1.0 | 1.4:1.0 | 1.9:1.0 | 1.0:1.0 | 1.3:1.0 | 1.7:1.0 |
| Stable? | no | no | no | yes | yes | no | yes | yes |
| Working Bath Appearance | poor; precipitate evident | poor; clear solution | poor; precipitate evident | normally turbid | normally turbid | fair, slight precipitate | normally turbid | normally turbid |
| | Appearance of Phosphate Coating After Activation with Composition Aged for: | | | | | | | |
| 0 (Fresh) | good | good | good | good | good | good | good | good |
| 2 months | fair | fair-good | poor | good | good | good | good | good |
| 6 months | very poor | very poor | very poor | good | good | fair | good | good |

Notes for Table 1

"JS" means Jernstedt salt; the percentage concentration of titanium in the salt is indicated by the number following the hyphen after the "JS" symbol.

"K:Ti Rat." means the ratio of the potassium atom content to the content of titanium in the Jernstedt salt content of the composition.

"Cond. P:Ti" means the ratio of the weight of the phosphorus containing anions in the total content of lower condensed phosphate ions in the composition to the total weight of titanium in the Jernstedt salt content of the composition.

"K:Na Rat." means the ratio of the weight of the total potassium atoms in the composition to the weight of the total sodium atoms in the composition.

"Stable?" means "Was the concentrate stable for at least six months?"

In the description of the quality of the phosphate coatings formed, "good" means a fine grained, very uniform coating; "fair" means a coating with larger crystals that "good", and the coating may have a few void areas; "poor" means a coating with very large grains and many void areas.

TKPP, STPP, and disodium phosphate "DSP") salts, all anhydrous, were used as obtained from commercial sources. KELZAN TM, KELZAN TM S, or KELZAN TM AR xanthan gums, all commercially available from Kelco Corp., were used as the thickeners, with little difference in performance among these various thickeners. Deionized water was used for preparing the concentrates.

To make working solutions, the concentrates were dissolved in water to give working activating compositions with a concentration of 4 grams of concentrate per liter of working composition. Substrates of cold rolled carbon steel, electrogalvanized steel, and aluminum were then contacted with the working compositions according to conventional procedures for activating, rinsed, and phosphate conversion coated with a zinc, manganese, and nickel containing phosphating composition (BONDERITE® 950 or 952, commercially available from the Parker+Amchem Div. of Henkel Corp., Madison Heights, Mich.). The compositions of the working solutions and some results are shown in Table 1.

The results in Table 1 indicate that Compositions 4–8 were satisfactory, with all of these except composition 6 being highly satisfactory, because they were stable in storage for six months and provided good quality activating after that time of storage. Composition 6 was slightly less satisfactory, because it was not stable for an entire six months and provided only fair activating after that time. However, it was fully stable for two months and provided good activation then. For many commercial users with well managed inventory control, such storage stability would be entirely adequate in practice. Even compositions 1–3 were satisfactory when fresh and have sufficiently long storage stability that they

What is claimed is:

1. A liquid activating concentrate consisting essentially of water and:
   (A) a component of dispersed Jernstedt titanium phosphate salt or salts;
   (B) a component of dissolved sodium salt or salts; and
   (C) a component of dissolved potassium salt or salts; and, optionally, one or more of the following:
   (D) a component of thickening agent; and
   (E) a conventional alkaline metal cleaner component, wherein in said liquid activating concentrate the ratio of potassium to titanium is within the range from about 8.0:1.0 to about 40:1.0 and the ratio of potassium to sodium is within the range from about 0.9:1.0 to about 2.5:1.0.

2. A liquid activating concentrate according to claim 1, wherein in said liquid activating concentrate the ratio of potassium to titanium does not exceed 24:1.0 and the ratio of potassium to sodium is at least 1.0:1.0.

3. A liquid activating concentrate according to claim 2, wherein the constituents of each of components (B) and (C) are selected from phosphate, pyrophosphate, and tripolyphosphate salts and the ratio of the total of pyrophosphate and tripolyphosphate to titanium in the Jernstedt salts in said liquid activating concentrate is within the range from about 10:1.0 to about 40:1.0.

4. A liquid activating concentrate according to claim 3, wherein component (B) is selected from the group consisting of sodium tripolyphosphate, disodium phosphate, and mixtures thereof and component (C) is tetrapotassium pyrophosphate; and the ratio of the total of tripolyphosphate and pyrophosphate to titanium in the Jernstedt salts in said liquid activating concentrate does not exceed 30:1.0.

5. A liquid activating concentrate according to claim 4, wherein tripolyphosphate is present in a concentration in the range from about 1 to about 3% and the concentrate contains xanthan gum thickener in a concentration in the range from 0.1 to 0.5%.

6. A liquid activating concentrate according to claim 5, wherein titanium from the Jernstedt salt component of said liquid activating concentrate is present in a concentration within the range from about 0.10to about 0.70%.

7. A liquid activating concentrate according to claim 6, wherein titanium from the Jernstedt salt component of said liquid activating concentrate is present in a concentration within the range from about 0.15 to about 0.50%.

8. A liquid activating concentrate according to claim 7, wherein titanium from the Jernstedt salt component of said liquid activating concentrate is present in a concentration within the range from about 0.20 to about 0.37%.

9. A liquid activating concentrate according to claim 4, wherein titanium from the Jernstedt salt component of said liquid activating concentrate is present in a concentration within the range from about 0.07 to about 1%.

10. A liquid activating concentrate according to claim 9, wherein titanium from the Jernstedt salt component of said liquid activating concentrate is present in a concentration within the range from about 0.10 to about 0.70%.

11. A liquid activating concentrate according to claim 10, wherein titanium from the Jernstedt salt component of said liquid activating concentrate is present in a concentration within the range from about 0.15 to about 0.50%.

12. A liquid activating concentrate according to claim 3, wherein titanium from the Jernstedt salt component of said liquid activating concentrate is present in a concentration within the range from about 0.05 to about 2.0%.

13. A liquid activating concentrate according to claim 12, wherein titanium from the Jernstedt salt component of said liquid activating concentrate is present in a concentration within the range from about 0.07 to about 1.0%.

14. A liquid activating concentrate according to claim 13, wherein titanium from the Jernstedt salt component of said liquid activating concentrate is present in a concentration within the range from about 0.10 to about 0.70%.

15. A liquid activating concentrate according to claim 2, wherein titanium from the Jernstedt salt component of said liquid activating concentrate is present in a concentration within the range from about 0.02 to about 5%.

16. A liquid activating concentrate according to claim 15, wherein titanium from the Jernstedt salt component of said liquid activating concentrate is present in a concentration within the range from about 0.05 to about 2.0%.

17. A liquid activating concentrate according to claim 16, wherein titanium from the Jernstedt salt component of said liquid activating concentrate is present in a concentration within the range from about 0.07 to about 1.0%.

18. A working activating composition prepared by diluting with water only a liquid activating concentrate according to claim 15 so that the concentration of titanium in Jernstedt salts in the working activating composition is within the range from 0.0003 to 0.004%.

19. A process comprising steps of activating a metal surface by contacting the surface with an aqueous alkaline liquid composition containing Jernstedt titanium phosphate salts and subsequently phosphate conversion coating the activated metal surface, wherein the improvement comprises activating the metal surface with a working activating composition according to claim 18.

20. A powdered solid mixture consisting essentially of:

(A) a component of Jernstedt titanium phosphate salt or salts;

(B) a component of water soluble sodium salt or salts; and (C) a component of water soluble potassium salt or salts; and, optionally, one or more of the following:

(D) a component of thickening agent; and (E) a conventional alkaline metal cleaner component, wherein in said powdered solid mixture the ratio of potassium to titanium is within the range from about 8.0:1.0 to about 40:1.0 and the ratio of potassium to sodium is within the range from about 0.9:1.0 to about 2.5:1.0.

* * * * *